US007322473B2

(12) United States Patent
Fux

(10) Patent No.: US 7,322,473 B2
(45) Date of Patent: Jan. 29, 2008

(54) PLASTIC PACKAGING WITH AT LEAST ONE WELDED KNOB

(75) Inventor: Rudolf Fux, Eschenburg (DE)

(73) Assignee: Convenience Food Systems Wallau GmbH & Co. KG, Wallau (DE)

( * ) Notice: Subject to any disclaimer, the term of this patent is extended or adjusted under 35 U.S.C. 154(b) by 412 days.

(21) Appl. No.: 10/475,738

(22) PCT Filed: Apr. 13, 2002

(86) PCT No.: PCT/EP02/04140

§ 371 (c)(1),
(2), (4) Date: Apr. 8, 2004

(87) PCT Pub. No.: WO02/087992

PCT Pub. Date: Nov. 7, 2002

(65) Prior Publication Data

US 2004/0154948 A1 Aug. 12, 2004

(30) Foreign Application Priority Data

Apr. 25, 2001 (DE) ..... 101 20 366

(51) Int. Cl.
*B65D 85/00* (2006.01)

(52) U.S. Cl. ..... 206/459.1; 206/467; 206/807; 206/459.5

(58) Field of Classification Search ..... 206/459.1, 206/459.5, 807, 467
See application file for complete search history.

(56) References Cited

U.S. PATENT DOCUMENTS 3,371,848 A 3/1968 Ward et al. ..... 229/45
4,197,947 A * 4/1980 Zaidi ..... 206/438
4,576,330 A * 3/1986 Schepp ..... 220/315
5,060,848 A 10/1991 Ewan ..... 229/102
5,103,979 A * 4/1992 Hustad ..... 206/459.1
5,180,599 A * 1/1993 Feldmeier et al. ..... 426/106
5,293,997 A * 3/1994 Hustad et al. ..... 206/467
5,581,978 A * 12/1996 Hekal et al. ..... 53/411
5,582,853 A * 12/1996 Marnocha et al. ..... 426/122
5,651,462 A * 7/1997 Simonsen et al. ..... 206/557

(Continued)

FOREIGN PATENT DOCUMENTS

DE 39 25 746 8/1989

(Continued)

*Primary Examiner*—Mickey Yu
*Assistant Examiner*—Steven A. Reynolds
(74) *Attorney, Agent, or Firm*—Perman & Green, LLP

(57) ABSTRACT

The invention relates to a plastic packaging (1) made from a packaging dish (2) and a cover lid (3). The cover lid (3) is at least partially sealed to the packaging dish (2) in a peelable manner and the cover lid (3), or the packaging dish (2), comprises at least one knob (5) and complementary to the above the packaging dish (2) or the cover lid (3) comprises a recess (6), through which the knob(s) is/are pressed on sealing the plastic packaging (1). At least a partial region of at least one knob is provided with a sealing material (95) or preferably at least one partial region of at least one knob (5) and the boundary region of the complementary recess (7) is connected to a sealing material (9), which on first opening of the packaging (1) is damaged. The invention further relates to methods for the production of said packages.

20 Claims, 6 Drawing Sheets

U.S. PATENT DOCUMENTS 5,830,547 A * 11/1998 MacKenzie et al. ..... 428/36.1
6,523,689 B2 * 2/2003 Mickel ..... 206/468

FOREIGN PATENT DOCUMENTS

| | | |
|---|---|---|
| DE | 690 29 272 | 9/1989 |
| DE | 39 41 183 | 12/1989 |
| DE | 41 24 462 | 7/1991 |
| DE | 92 03 598.1 | 3/1992 |
| DE | 42 40 327 | 12/1992 |
| DE | 43 00 771 | 1/1993 |
| DE | 94 09 933.2 | 6/1994 |
| DE | 198 40 046 | 9/1998 |
| DE | 198 59 042 | 12/1998 |
| DE | 198 59 043 | 12/1998 |
| EP | 0 595 368 | 11/1989 |
| EP | 0 379 927 | 1/1990 |
| EP | 0 381 329 | 1/1990 |
| EP | 0 385 565 | 1/1990 |
| EP | 0 427 512 | 11/1990 |
| EP | 0 427 513 | 11/1990 |
| EP | 0 506 295 | 3/1992 |
| EP | 0 564 695 | 9/1992 |
| EP | 0 386 490 | 9/1993 |
| EP | 0 408 516 | 12/1993 |
| EP | 0 716 986 | 6/1996 |
| EP | 0 579 262 | 9/1997 |
| EP | 0 621 197 | 8/2002 |
| GB | 2 150 531 | 11/1984 |
| WO | WO 97/05023 | 2/1997 |

* cited by examiner

PLASTIC PACKAGING WITH AT LEAST ONE WELDED KNOB

BACKGROUND OF THE INVENTION

1. Field of the Invention

The present invention relates to a plastic packaging made from a packaging cavity and a cover film, wherein the cover film is at least partially sealed in the sealing region to the packaging cavity so as to be peelable and the cover film, or the packaging cavity, comprises at least one knob and the packaging cavity or the cover film complementary to this has at least one recess, through which the knob(s) is(are) pushed upon sealing the plastic packaging, wherein at least one partial region of at least one knob is provided with a sealing material or preferably at least one partial region of at least one knob and the edge region of the complementary recess are connected with a sealing material which is damaged upon first opening of the packaging.

2. Brief Description of Related Developments

The invention further relates to methods for the manufacture of the packagings according to the invention.

Goods for packaging, foodstuffs in particular, are nowadays increasingly offered for sale in plastic packaging. This plastic packaging has a packaging cavity in which the packaged goods are disposed and a cover film. The cover film is sealed to the packaging cavity. As the goods to be packaged are frequently not used immediately after opening, it is advantageous if the packaging can be re-sealed after opening.

There was therefore no lack of trials in the past to make available re-sealable packaging. EP 0 564 695, DE 39 25 746, EP 0 386 490, DE 39 41 183, EP 0 408 516, WO 97/05023, EP 0 716 986, EP 0 595 368, EP 0 579 262, EP 0 506 295, EP 0 427 513, EP 0 427 512, EP 0 385 565, EP 0 381 329 or EP 0 379 927 are cited here only as examples in which either procedures or devices for the manufacture of re-sealable packaging and/or the re-sealable packaging itself are taught.

All re-sealable packagings disclosed in the above-mentioned publications have either the disadvantage that they are expensive to manufacture and/or are not effectively re-sealable.

The German patent application with the file reference DE 198 59 042.3 teaches a plastic packaging provided with knobs comprising a packaging cavity and a cover film, the cover film being sealed to the packaging cavity in the sealing region so as to be at least partially peelable and the cover film or the packaging cavity having at last one knob and the packaging cavity or the cover film having at least one recess complementary to this, through which the knob is pushed, so that the plastic packaging is re-sealable after opening.

The disadvantage with plastic packaging provided with knobs is that the user of the closed packaging mostly cannot discern the extent to which the packaging is still in the unopened original state, or whether the packaging has already been opened. With original, sealed packaging the user generally assumes the product content has not been consumed. Plastic packaging provided with knobs in particular for perishable foodstuffs makes the user uncertain.

SUMMARY OF THE INVENTION

The object of this invention is therefore to make available plastic packaging provided with at least one knob and which does not have the disadvantages of the state of the art.

This object is solved through the provision of plastic packaging made of a packaging cavity and a cover film, the cover film being sealed to the packaging cavity in the sealing region so as to be at least partially peelable and the cover film or the packaging cavity having at least one knob and the packaging cavity or cover film complementary to this having at last one recess, through which the knob(s) is/are pushed when the plastic packaging is sealed, whereby at last one partial region of at least one knob is provided with sealing material or preferably at least one partial region of at least one knob and the edge region of the complementary recess is connected with sealing material, which is damaged on first opening of the packaging.

A packaging cavity according to the invention is any packaging cavity familiar to the person of ordinary skill in the art that is preferably manufactured from a thermoplastic, dimensionally-stable single- or multi-layer film customary for the packaging of foodstuffs.

On at least one of its two surfaces, the film must have a sealing layer which is peelable. A mixture of LDPE (low density polyethylene) and polybutylene is preferably used as a sealing layer. The mixture preferably comprises 15 to 30 weight %, particularly preferably 20 to 28 weight % polybutylene. The polybutylene preferably has a melt-flow index (MFI) in the region of 0.3 to 2.0 g/10 min (190° C. and 216 kg in accordance with ASTM 1238).

It is particularly preferred to manufacture the packaging cavity from a multi-layer film with foamed carrier film, preferably a foamed polyolefin film, particularly preferably polypropylene film.

It is most especially preferred to manufacture the packaging cavity from a film as disclosed in the patent application with the German Patent Office file reference 198 40 046.2. This patent application is introduced herewith as reference and so counts as part of the disclosure.

The thermoformed, preferably deep-drawn, packaging cavities are sealed after filling with the goods to be packaged with a preferably deep-drawn cover film familiar to the person of ordinary skill in the art. Multi-layer films with gas barrier layer made of ethylene vinyl alcohol copolymer, preferably polyethylene terephthalate (PET)/coupling layer/polyethylene/coupling layer/ethylene vinyl alcohol copolymer/coupling layer/polyethylene, the polyethylene terephthalate layer being replaceable by polypropylene, are suitable as cover films.

If the cover film of the packaging according to the invention has the recess, it can also have $SiO_x$ as a gas barrier layer. The cover film is then preferably made of PET/$SiO_x$/coupler/polyethylene.

The cover film is sealed according to the invention to the packaging cavity in the sealing region, the cover film being sealed to the packaging cavity so as to be at least partially peelable. For peelable sealing, the cover is sealed to the packaging cavity at a temperature of 130° C. to 150° C., preferably from 135 to 145° C., and at a pressure of 3 to $8\times10^5$ N/m$^2$, preferably from 4.0 to $5.0\times10^5$ N/m$^2$. If the packaging according to the invention is to have a non-peelable, i.e. firmly sealed partial region of the sealing region, the firm sealing is preferably undertaken at a temperature at least 10° C. higher and at preferably twice the pressure compared to peelable sealing. A firm sealing in the sense of the invention is a sealing in which the separation force of the cover film has to be at least five times higher than in the region of the peelable sealing.

The sealing region on the packaging cavity is preferably disposed in a horizontal plane, preferably above the goods to be packaged, and preferably extends along this plane around the whole of the goods to be packaged. In the case of a polygonal plastic packaging, the cover film can be firmly sealed to the packaging cavity on preferably at least one side of this polygon, whilst the cover film is sealed to the packaging cavity in the remaining sealing region so as to be peelable. In the case of round packaging, preferably 5-25% of the sealing region can be provided with a firm sealing.

According to the invention the packaging cavity or the cover film has at least one recess disposed preferably in the horizontal plane above the goods to be packaged. The recess may have any shape and size but must be compatible, however, with the shape of the knob. The recess is preferably approximately circular with a diameter of 3 to 12 mm, preferably from 4 to 9 mm. The recess is preferably bored or punched in the packaging cavity or the cover film, punching being particularly preferred.

Also in accordance with the invention, the cover film or the packaging cavity has at least one knob disposed complementarily to the recess in the packaging cavity or the cover film, the shape of which knob must be compatible with the shape of the recess, so that it can be pushed through the recess and remain there. The knob is preferably approximately cylindrical with a diameter of preferably 3 to 12 mm and a length of preferably 3 to 15 mm, 4 to 8 mm being particularly preferred. Most particularly preferably, the diameter of the knob is ≦ the diameter of the approximately circular recess.

The knob(s) and the recess(es) is/are preferably disposed closer to the outer edge of the plastic packaging than the sealing region.

Where there is a firm sealing region, the knob(s) and/or the complementary recess(es) are preferably attached to the plastic packaging so that they are disposed outside the region of the firm sealing, preferably diametrically opposite. This arrangement has the advantage that the cover film can be stretched and then connected firmly yet detachably with the knob seal(s).

In a preferred packaging embodiment the cover film has the recess(es) and the packaging cavity the knob(s).

The plastic packaging according to the invention can preferably have additional means for resealing the packaging. Such means are preferably a zip, as disclosed for example in EP 0 621 197 A1, a sealing lip, a snap closure, as disclosed in EP 0 427 512, or a hook-and-loop fastener, as disclosed in the parallel application with the internal file reference CH 8006. These publications and/or the parallel application are herewith introduced as reference and are therefore part of the disclosure.

In the case of the packaging according to the invention at least one partial region of at least one knob is provided with a sealing material, preferably at least one partial region of at least one knob and the edge region of the complementary recess is connected with a sealing material which is damaged on first opening of the package.

The damage to the sealing material caused by the first opening of the packaging preferably takes the form of a break and/or at least the partial falling-away of at least one section of the sealing material and/or deformation of at least one section of the sealing material, the damage preferably being detectable without technical assistance.

Damage which can be detected without technical assistance is damage which can be seen and/or felt without difficulty. Damage that can be felt is of great benefit for visually-impaired consumers in particular.

In a preferred embodiment the colour of the sealing material differs from the colour of the plastic packaging. Especially preferred are clear and/or stark colour contrasts, for example white and black or yellow and red.

In a further preferred embodiment, a damaged sealing material has a texture which differs from the undamaged sealing material and which can in particular be felt easily by visually-impaired customers.

In yet a further preferred embodiment of the invention, the surface of the sealing material has a different colour from that of the sealing material itself, damage to the sealing material leading to the sealing surface of the differently-coloured sealing material becoming visible.

In another preferred embodiment, the sealing material itself has sufficient adhesive strength when attached to the packaging knob to guarantee securing to a knob, preferably to one knob and to the edge region of a complementary recess, and to guarantee the storage and the customary transport of the plastic packaging, whereby first opening of the plastic packaging effects at least a partial separation or deformation, preferably a break and, especially preferred, the complete separation of the sealing material from the plastic packaging.

Such adhesive strength can be realised where appropriate by loosening with a solvent and/or by heating.

In yet another preferred embodiment, natural or synthetic waxes or plastics are used as sealing materials. Especially preferred are plastics which harden under the effect of air and/or heat and/or radiation such that the sealing material becomes so brittle that it is easily damaged.

The sealing materials are preferably self-adhesive. Especially preferred here are sealing materials which are self-adhesive in a heated state.

In a further preferred embodiment, sealing materials are attached using an adhesive material to at least one knob, preferably at least one knob and the edge region of the complementary recess.

Most especially preferred are sealing materials which are so brittle that they break upon first opening of the packaging.

Packagings provided with knobs according to the invention are preferably re-sealable.

Particularly preferably, foodstuffs, preferably firm, and especially preferred, fresh or cooked meat or sausage, are packed in the packaging according to the invention.

The plastic packaging according to the invention is preferably manufactured by way of forming the packaging cavity by deep drawing a film. Subsequently or at the same time, a recess is made in the packaging cavity, preferably by punching, or a knob is formed by thermoforming. In the following procedure step the packaging cavity is optionally filled and a cover film then sealed on the packaging cavity, gas being exchanged where appropriate prior to sealing to extend the life of the foodstuff in the packaging.

Subsequently, or at the same time as sealing, at least one knob is preferably manufactured by thermoforming the cover film, or at least one recess is punched out. The manufacture of the knob is preferably achieved using a punch or compressed air with which the material to be deformed is pressed through the recess.

After the product has been sealed in the packaging, sealing material is attached at least to one knob, preferably to a knob and to the edge region of the complementary recess.

The packaging according to the invention enables the consumer to identify quickly and unambiguously the original packaging state of the product. In the case of foodstuff packaging that is originally packed in an airtight manner and then re-sealed after first opening, the consumer can draw conclusions as to the state of the contents of the packaging by the intactness of or damage to the sealing material, without having to inspect the product itself or investigate it in detail.

With plastic packaging according to the invention that re-sealable by at least one knob, it is possible to re-seal the packaging, once opened, well and yet detachably. It is easy for the user to seal and/or open. The plastic packaging is simple and cost-effective to manufacture.

In a further aspect this Invention also relates to methods for the manufacture of the plastic packaging according to the invention. According to the invention such methods comprise the following steps:

1. the manufacture of a packaging cavity by thermoforming from a film, and either
2. the formation of at least one recess in the packaging cavity, preferably by punching,
3. optional filling of the packaging cavity,
4. the sealing of a cover film to the packaging cavity and
5. the manufacture of a complementary knob by thermoforming the cover film, or 2a. forming at least one knob in the edge region of the packaging cavity formed in step 1, and 4a forming in the cover film, before or during sealing with the packaging cavity, at least one complementary packaging, whereby at least one partial region of at least one knob is provided with a sealing material, or preferably at least one partial region of at least one knob and the edge region of the complementary recess is connected with sealing material which is damaged upon first opening of the packaging.

The invention is described in the following on the basis of FIGS. 1 to 3. The explanations are solely by way of example and do not restrict the general thought behind the invention.

DETAILED DESCRIPTION OF THE PREFERRED EMBODIMENT(s)

Figure 1:
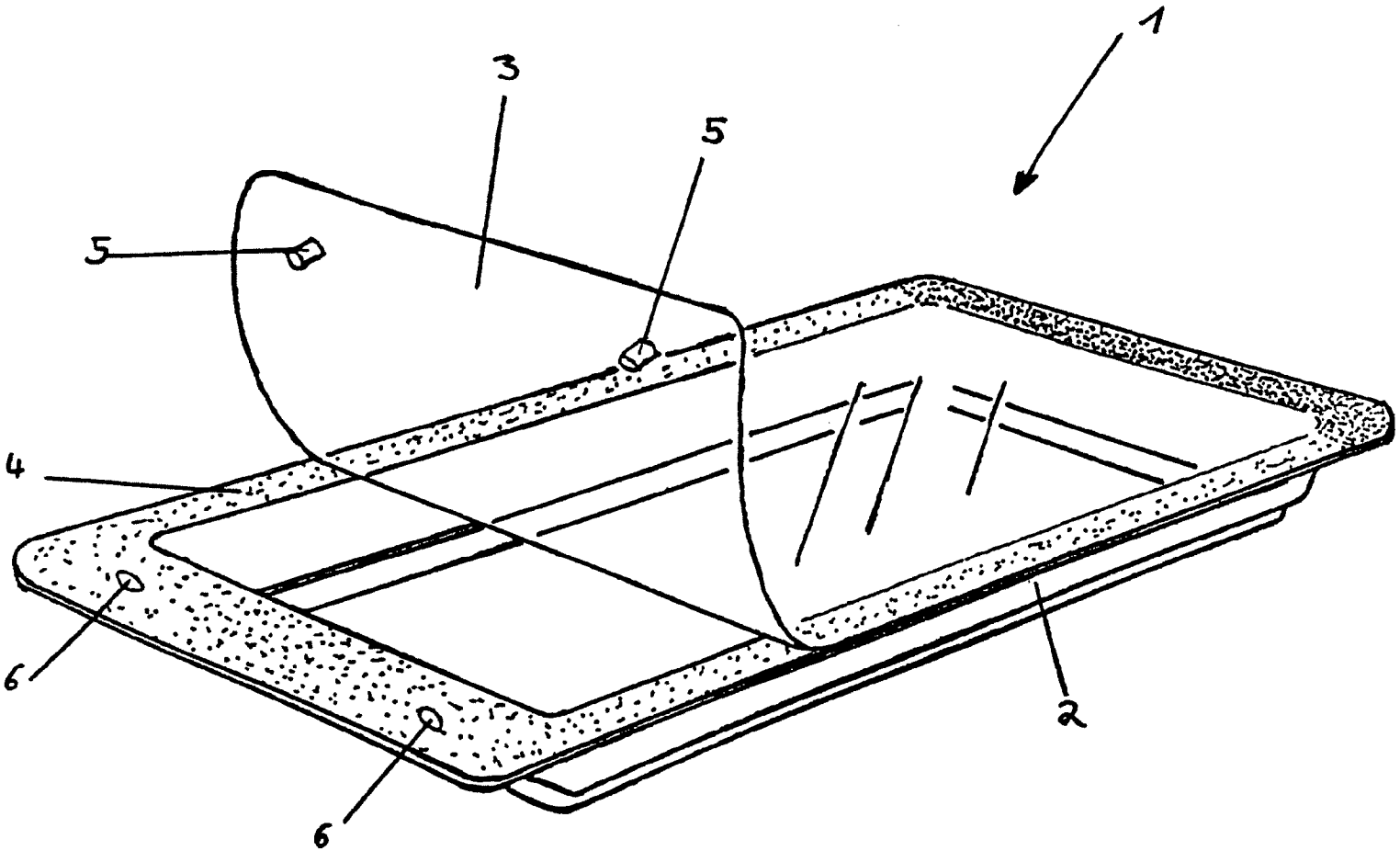
FIG. 1 shows a plastic packaging provided with knobs.

FIG. 1 shows a plastic packaging 1 according to the invention, comprising a packaging cavity 2 and a cover film 3. The packaging has a sealing region 4 which is disposed horizontally and extends round the entire packing cavity 2. In this sealing region 4 the cover film 3 is sealed to the packaging cavity 2, the cover film being sealed peelably to the packaging cavity in the lightly dotted section of the sealing region 4, whilst in the heavily dotted section of the sealing region 4 it is sealed firmly to the packaging cavity. Upon opening, the cover film is only pulled off on three sides from the packaging cavity and remains connected with this packaging cavity in the section of the firm sealing. The cover film, a semi-rigid polyethylene enterephthalate/EVOH/polyethylene-polybutylene film, has two approximately cylindrical knobs which have a length of 4 mm and a diameter of 7 mm. The knobs 5 have been imprinted in the cover film by thermoforming with a stamp. The packaging cavity 2 has two approximately circular recesses 6 which are disposed opposite the knobs 5 and have a diameter of 7 mm.

The person of ordinary skill in the art will appreciate that the knobs 5 and/or the recesses 6 may also be disposed in other locations on the plastic packaging and/or that further knobs/cavities may be present in addition to the two shown.

The person of ordinary skill in the art will also appreciate that in addition to the knobs, further re-sealing means may be disposed on the packaging cavity and/or the cover film.

After opening the cover film the packaging can be re-sealed, the knobs 5 being pressed into the recesses 6 and remaining there until the cover film is pulled off again and the knobs therefore pulled out of the recesses.

Figure 2:
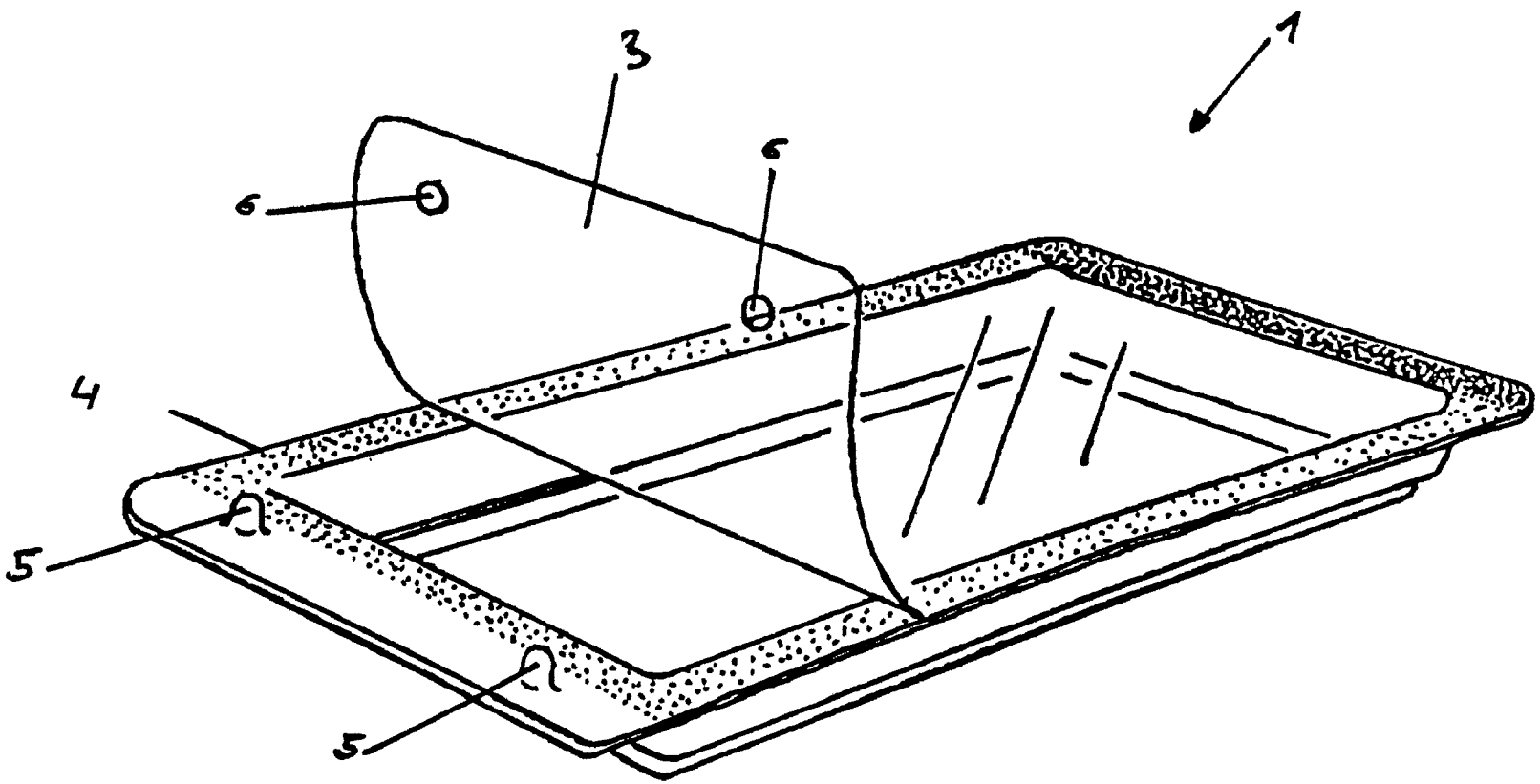
FIG. 2 shows a further plastic packaging provided with knobs.

FIG. 2 shows a plastic packaging 1 in accordance with FIG. 1, the knobs 5, however, being made in the packaging cavity 4 and the recess 6 in the cover film 3.

FIGS. 3A to F show side-view sections of the plastic packaging according to the invention before and after opening.

Legends for FIGS. 3A-F

7. Edge region of the recess corresponding to knob 5
8. Sealing region of a packaging cavity or cover film
5. Knob in the sealing region of a packaging cavity or cover film
9. Sealing material at a knob 5 or sealing material at a knob 5 and the edge region of the recess corresponding to the knob.

Figure 3:
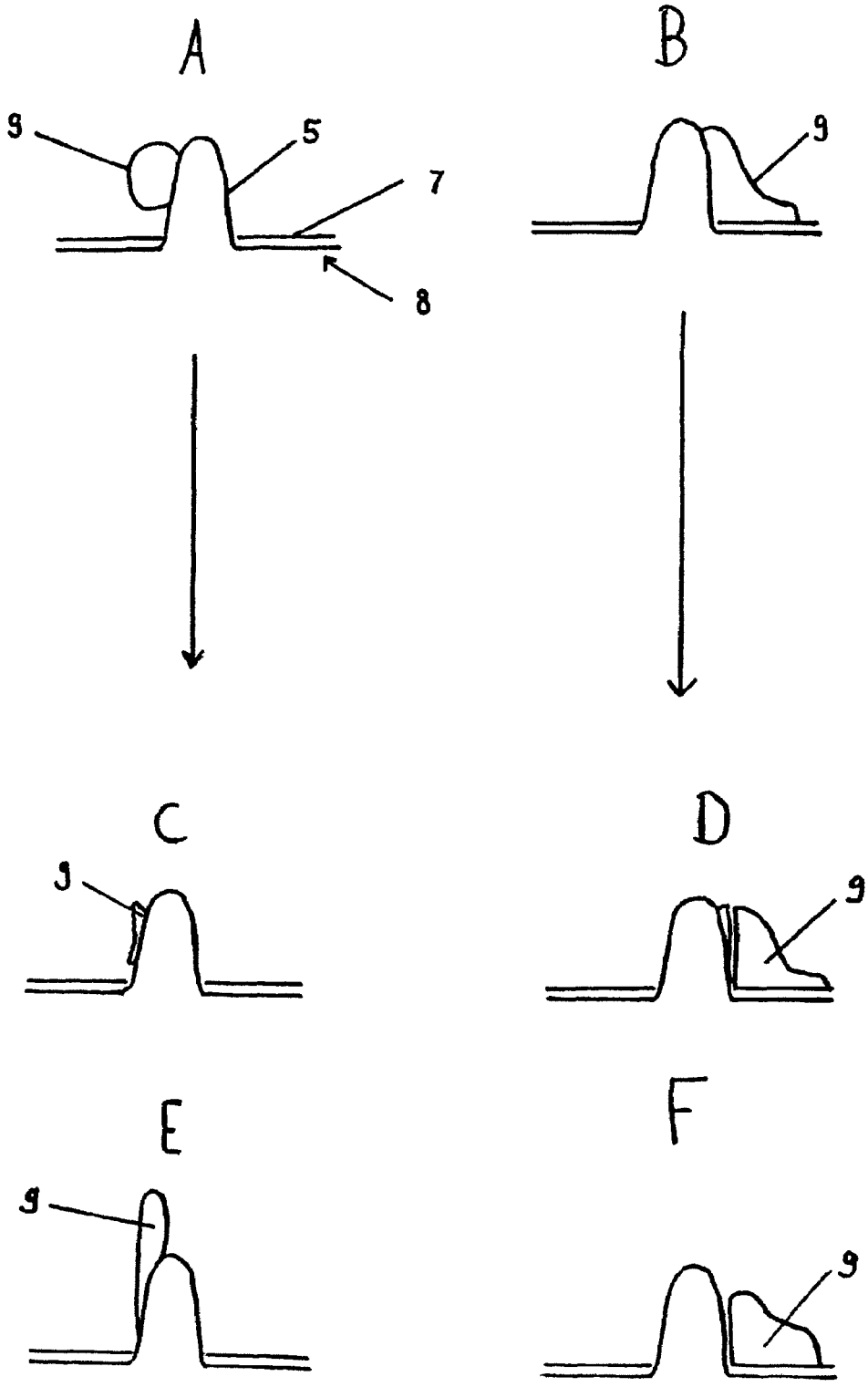
FIGS. 3A-F show sections of the plastic packaging according to the invention before and after opening.
Figure 4:
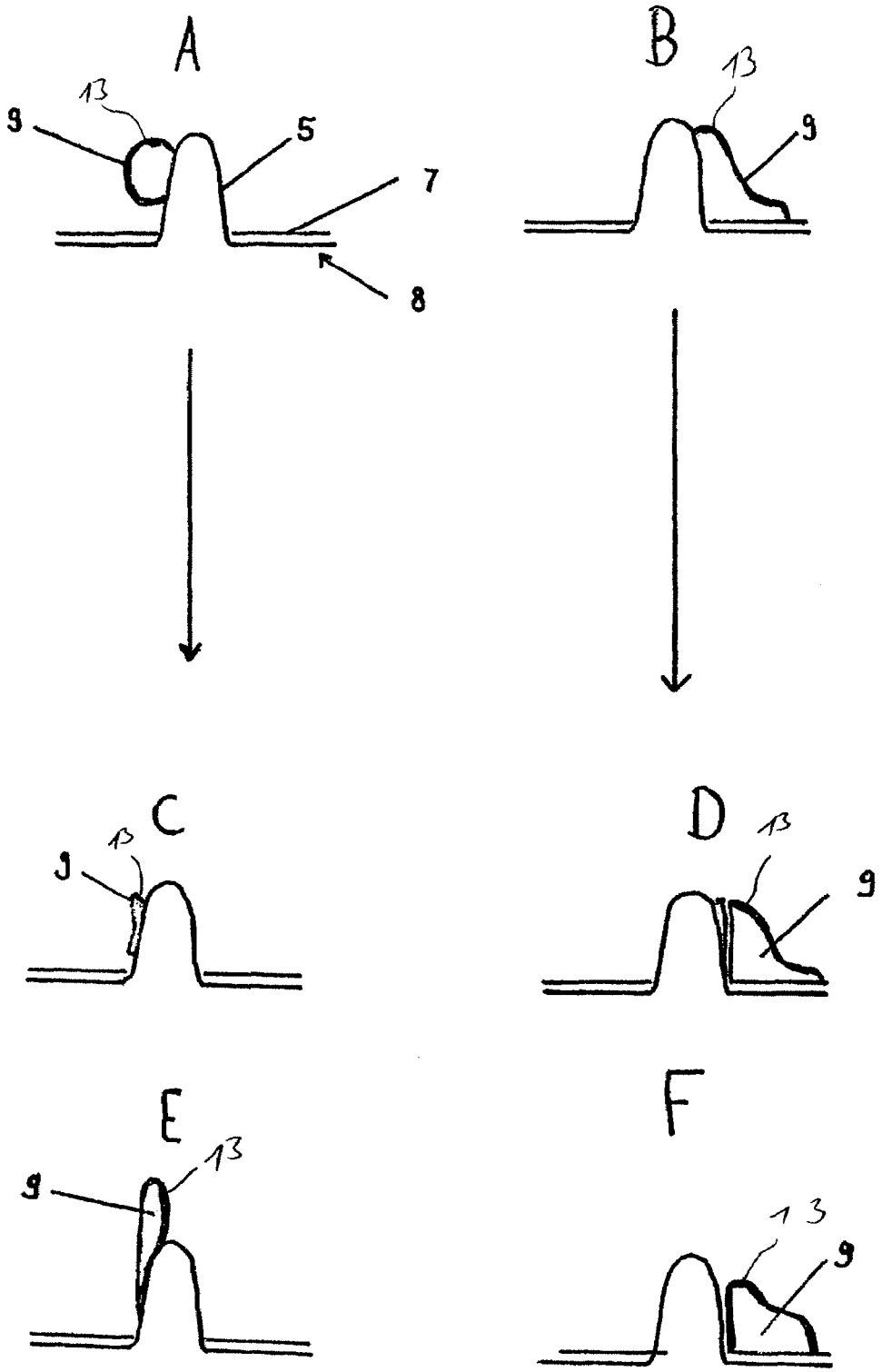
FIGS. 4A-F show a plastic packaging where the sealing material itself has a color and the surface of the sealing material has a different color.
Figure 5:
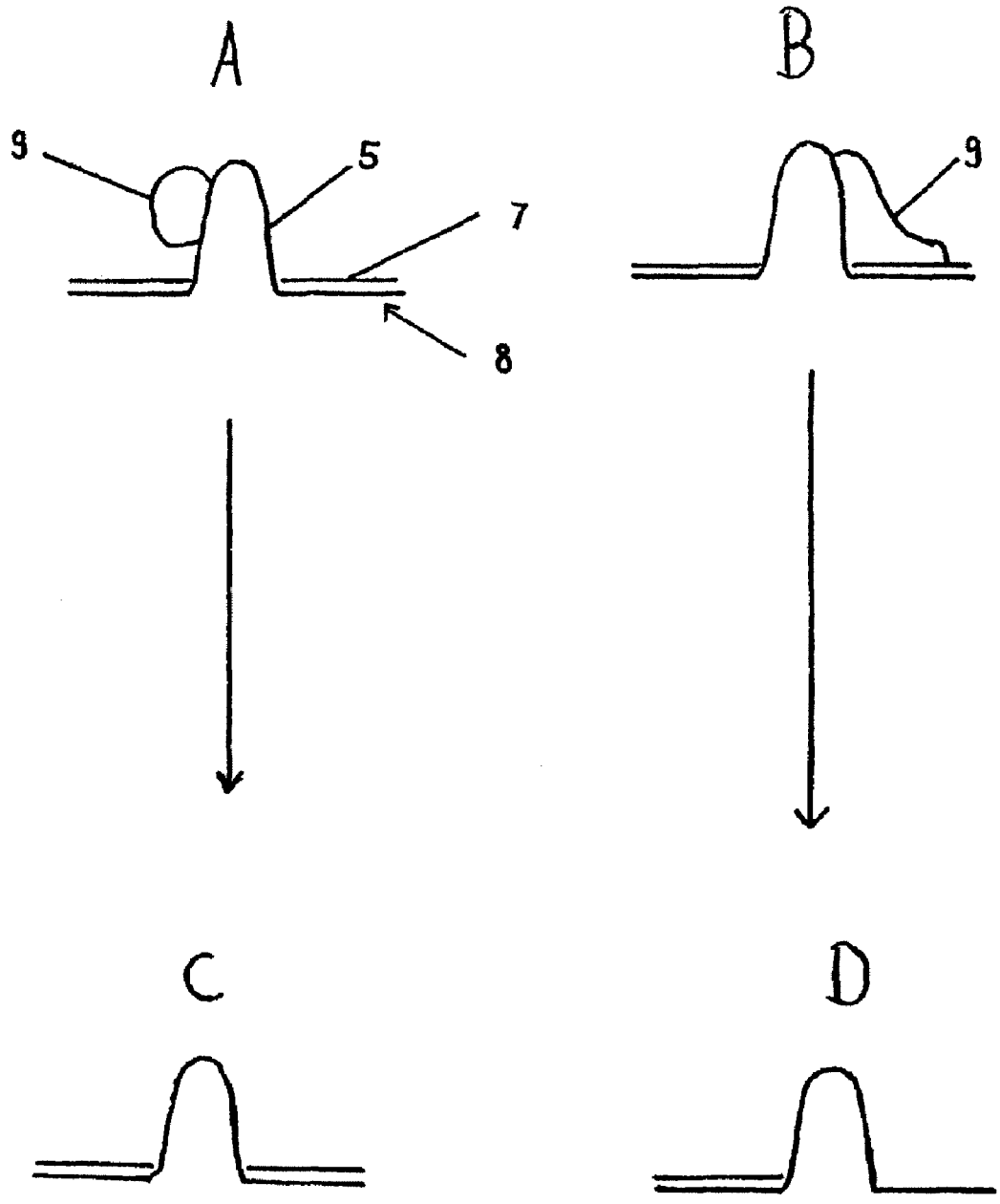
FIGS. 5A-D show a plastic packaging where the sealing material breaks away completely from the plastic packaging.

FIG. 3A shows a knob 5, of which a partial region is provided with sealing material 9.

FIG. 3B shows a knob 5, of which a partial region is provided with sealing material 9, the sealing material forming a connection between the knob 5 and the edge region of the recess 7 corresponding to the knob.

FIG. 3C shows the object of FIG. 3A, after the sealing material 9 has been damaged by breaking upon first opening of a packaging 1.

FIG. 3D shows the object of FIG. 3B, after the sealing material 9 has been damaged by breaking upon first opening of packaging 1.

FIG. 3E shows the object of FIG. 3A, after the sealing material 9 has been damaged by deformation upon first opening of a packaging 1.

FIG. 3F shows the object of FIG. 3B, after the sealing material 9 has been damaged by deformation upon first opening of a packaging 1.

FIGS. 4A-F show that the sealing material (9) itself has a color and the surface (13) of the sealing material (9) has a different color, wherein first opening of the plastic packaging (1) damages the surface color (13) of the sealing material (9) in such a way that the color of the underlying sealing material (9) becomes visible.

FIGS. 5A-D show a plastic packaging where the sealing material is damaged upon first opening of the packaging so that the damage is a breaking away of the sealing material.

Figure 6:
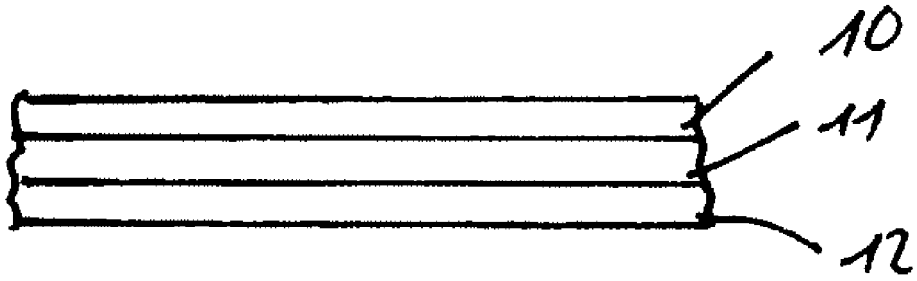
FIG. 6 shows a packaging cavity with basis layer, a gas barrier layer and a peelable sealing layer.

FIG. 6 shows a packaging cavity with basis layer (10), a gas barrier layer (11) and a peelable sealing layer (12).

Figure 7:
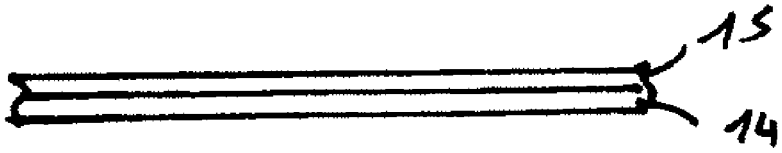
FIG. 7 shows a cover film having barrier layer and polyethylene layer.

FIG. 7 shows a cover film having barrier layer (15) and polyethylene layer (14).

What is claimed is:

1. Plastic packaging comprising a packaging cavity and a cover film, wherein the cover film is sealed in a sealing region to the packaging cavity so as to be at least partly peelable, the cover film or the packaging cavity having at least one knob, and the packaging cavity or the cover film having at least one hole complementary to the knob, through which the knob(s) is or are pushed through upon sealing the plastic packaging so that at least one partial region of the at least one knob passes through the hole and projects out of the packaging cavity or the cover film, wherein after the knob has been pushed through the hole, a sealing material is attached to the at least one partial region of the at least one knob that projects out of the packaging cavity or the cover film, where the sealing material is damaged upon a first opening of the packaging.

2. Plastic packaging according to claim 1, wherein the damage is a break, an at least partial falling-away and/or a deformation of the sealing material.

3. Plastic packaging according to claim 1, wherein the damage can be seen and/or felt without having to inspect the sealing material in detail.

4. Plastic packaging according to claim 1, wherein the sealing material has a color that is different from the color of the plastic packaging.

5. Plastic packaging according to claim 1, wherein the sealing material itself has a color and the surface of the sealing material has a different color, wherein a first opening of the plastic packaging damages the surface color of the sealing material in such a way that the color of the underlying sealing material becomes visible.

6. Plastic packaging according to claim 1, wherein the sealing material has sufficient adhesive strength to secure the at least one knob and an edge region of a complementary recess, for the storage and customary transport of the plastic packaging, wherein a first opening of the plastic packaging causes the sealing material to at least partially fall away and/or deform or to break and cause the sealing material to fall away completely from the plastic packaging.

7. Plastic packaging according to claim 1, wherein the sealing material is a natural or synthetic wax or a plastic which hardens under the effect of air and/or heat and/or radiation such that the sealing material becomes so brittle that it is easily damaged when the packaging is opened.

8. Plastic packaging according to claim 1, wherein the sealing material is self-adhesive.

9. Plastic packaging according to claim 8, wherein the sealing material is self-adhesive in a heated state.

10. Plastic packaging according to claim 1, wherein the sealing material is applied to the at least one knob using an adhesive material.

11. Plastic packaging according to claim 10, wherein the sealing material is applied to the an edge region of the complementary recess, using an adhesive material.

12. Plastic packaging according to claim 1, wherein the sealing material is brittle and breaks upon a first opening of the plastic packaging.

13. Plastic packaging according to claim 1, wherein the packaging is resealable through the introduction of the at least one knob in the at least one hole.

14. Plastic packaging according to claim 1, wherein the cover film comprises a thermoformable film made of polyethylene terephthalate or polypropylene, and the packaging cavity comprises a foamed polyolefin in film.

15. Plastic packaging according to claim 14, wherein the packaging cavity comprises a foamed polyolefin film as a basis layer, a gas barrier layer and a peelable sealing layer.

16. Plastic packaging according to claim 14, wherein the cover film further comprises an ethylene vinyl alcohol copolymer barrier layer and polyethylene.

17. Plastic packaging according to claim 1, wherein the sealing region is completely peelable.

18. Plastic packaging according to claim 1, wherein one side or 5-25% of the sealing region is firmly sealed.

19. Plastic packaging according to claim 18, wherein the knob(s) and complementary recess(es) are disposed outside the firm sealing region.

20. Method for the manufacture of a plastic packaging (1) according to claim 1, characterised in that 1. the packaging cavity is produced by thermoforming from a film, either
2. at least one recess is made, preferably punched, in the packaging cavity,
3. the packaging cavity (2) is optionally filled,
4. a cover film (3) is sealed to the packaging cavity and
5. the complementary knob is produced by thermoforming the cover film, or 2a. at least one knob is formed in the edge region of the packaging cavity produced in step 1. and 4a. at last one complementary packaging is made in the cover film before or after sealing with the packaging cavity, characterised in that at least one partial region of at least one knob (5) is provided with a sealing material (9), or preferably at least one partial region of at least one knob (5) and the edge region of the complementary recess (7) are connected with a sealing material (9), which is damaged upon first opening of the packaging.

* * * * *